US009809417B2

(12) United States Patent
Mellin

(10) Patent No.: US 9,809,417 B2
(45) Date of Patent: Nov. 7, 2017

(54) SURFACE WINDER

(71) Applicant: The Procter & Gamble Company, Cincinnati, OH (US)

(72) Inventor: Gustav André Mellin, Amberley Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 139 days.

(21) Appl. No.: 14/826,594

(22) Filed: Aug. 14, 2015

(65) Prior Publication Data

US 2017/0043975 A1 Feb. 16, 2017

(51) Int. Cl.

| | |
|---|---|
| ***B65H 18/28*** | (2006.01) |
| ***B65H 75/24*** | (2006.01) |
| ***B65H 18/02*** | (2006.01) |
| ***B65H 19/22*** | (2006.01) |
| ***B65H 18/14*** | (2006.01) |
| ***B65H 18/20*** | (2006.01) |
| ***B65H 18/26*** | (2006.01) |

(52) U.S. Cl.

CPC ..... *B65H 75/243* (2013.01); *B65H 18/028* (2013.01); *B65H 18/145* (2013.01); *B65H 18/20* (2013.01); *B65H 18/26* (2013.01); *B65H 19/2269* (2013.01); *B65H 2301/41346* (2013.01); *B65H 2301/41468* (2013.01); *B65H 2405/45* (2013.01); *B65H 2406/15* (2013.01); *B65H 2408/235* (2013.01); *B65H 2515/342* (2013.01); *B65H 2701/1924* (2013.01)

(58) Field of Classification Search

CPC ..... B65H 75/243; B65H 18/028; B65H 19/2269; B65H 2408/235

See application file for complete search history.

(56) References Cited

U.S. PATENT DOCUMENTS 3,630,462 A 12/1971 Nordgren et al.
3,791,602 A 2/1974 Isakson
(Continued)

FOREIGN PATENT DOCUMENTS

CA 2074621 A1 2/1993
CN 102126634 A 7/2011
(Continued)

OTHER PUBLICATIONS

PCT International Search Report, dated Apr. 25, 2017, 130 pages.

*Primary Examiner* — Sang Kim
(74) *Attorney, Agent, or Firm* — Andrew J. Mueller

(57) ABSTRACT

A rewinding machine for convolutley winding a web material onto a core to is disclosed. The rewinding machine comprises a first winding drum rotatable at a first peripheral velocity, a second winding drum opposed to the first winding drum and rotatable at a second peripheral velocity, and a core support for gripping opposing ends of the core. The core support grips opposing ends of the core during winding of the web material about the core. The core support has first and second rotatable pins each having corresponding first and second ends capable of insertion into a respective end of the core. The first rotatable pin has a channel that provides fluid communication between a source of positive pressure disposed external to the first rotatable pin and the second end of the first rotatable pin to provide positive pressure to the interior portion of the core.

16 Claims, 15 Drawing Sheets

(56) References Cited

U.S. PATENT DOCUMENTS

| | | | |
|---|---|---|---|
| 4,487,377 | A | 12/1984 | Perini |
| 4,541,583 | A | 9/1985 | Forman et al. |
| 4,588,138 | A | 5/1986 | Spencer |
| 4,635,871 | A | 1/1987 | Johnson et al. |
| 4,723,724 | A | 2/1988 | Bradley |
| 4,828,195 | A | 5/1989 | Hertel et al. |
| 4,856,752 | A | 8/1989 | Linn |
| 4,909,452 | A | 3/1990 | Hertel et al. |
| 4,962,897 | A | 10/1990 | Bradley |
| 5,031,850 | A | 7/1991 | Biagiotti |
| 5,104,155 | A | 4/1992 | Kirkwood |
| 5,137,225 | A | 8/1992 | Biagiotti |
| 5,226,611 | A | 7/1993 | Butterworth et al. |
| 5,267,703 | A | 12/1993 | Biagiotti |
| 5,285,979 | A | 2/1994 | Francesco |
| 5,312,059 | A | 5/1994 | Membrino |
| 5,368,252 | A | 11/1994 | Biagiotti |
| 5,370,327 | A | 12/1994 | Adamski |
| 5,370,335 | A | 12/1994 | Vigneau |
| 5,402,960 | A | 4/1995 | Oliver et al. |
| 5,431,357 | A | 7/1995 | Rueegg |
| 5,505,405 | A | 4/1996 | Vigneau |
| 5,538,199 | A | 7/1996 | Biagiotti |
| 5,542,622 | A | 8/1996 | Biagiotti |
| 5,603,467 | A | 2/1997 | Perini et al. |
| 5,769,352 | A | 6/1998 | Biagiotti |
| 5,772,149 | A | 6/1998 | Butterworth |
| 5,779,180 | A | 7/1998 | Smedt et al. |
| 5,839,680 | A | 11/1998 | Biagiotti |
| 5,845,867 | A | 12/1998 | Hould et al. |
| 5,909,856 | A | 6/1999 | Myer et al. |
| 5,934,602 | A | 8/1999 | Jendroska et al. |
| 5,979,818 | A | 11/1999 | Biagiotti et al. |
| 6,000,657 | A | 12/1999 | Butterworth |
| 6,039,285 | A | 3/2000 | Biagiotti |
| 6,056,229 | A | 5/2000 | Dual et al. |
| 6,098,916 | A | 8/2000 | Matteucci et al. |
| 6,129,304 | A | 10/2000 | Biagiotti |
| 6,168,679 | B1 | 1/2001 | Biagiotti |
| 6,286,419 | B1 | 9/2001 | Wallace |
| 6,378,799 | B1 | 4/2002 | Gambini |
| 6,390,408 | B1 | 5/2002 | Madrzak et al. |
| 6,554,754 | B2 | 4/2003 | VanRens |
| 6,565,033 | B1 | 5/2003 | Biagiotti |
| 6,595,458 | B1 | 7/2003 | Biagiotti |
| 6,595,459 | B2 | 7/2003 | Hanson |
| 6,648,266 | B1 | 11/2003 | Biagiotti et al. |
| 6,659,387 | B2 | 12/2003 | Biagioni et al. |
| 6,676,063 | B2 | 1/2004 | Gambini |
| 6,698,681 | B1 | 3/2004 | Guy et al. |
| 6,705,564 | B2 | 3/2004 | Bootsman et al. |
| 6,715,709 | B2 | 4/2004 | Stephens et al. |
| 6,729,572 | B2 | 5/2004 | Baggot et al. |
| 6,752,344 | B1 | 6/2004 | Biagiotti |
| 6,752,345 | B2 | 6/2004 | Betti et al. |
| 6,866,220 | B2 | 3/2005 | Sosalla et al. |
| 6,945,491 | B2 | 9/2005 | Gambini |
| 7,175,126 | B2 | 2/2007 | Perini |
| 7,293,736 | B2 | 11/2007 | Recami et al. |
| 7,338,006 | B2 | 3/2008 | Gelli et al. |
| 7,344,104 | B2 | 3/2008 | Hada et al. |
| 7,472,860 | B2 | 1/2009 | Niskanen |
| 7,784,723 | B2 | 8/2010 | Moore |
| 7,909,282 | B2 | 3/2011 | Wojcik et al. |
| 7,931,226 | B2 | 4/2011 | Benvenuti et al. |
| 7,938,355 | B2 | 5/2011 | Benvenuti |
| 7,942,363 | B2 * | 5/2011 | Gelli ..... B65H 18/26 242/532.2 |
| 8,844,859 | B2 | 9/2014 | Deonarine |
| 2007/0176039 | A1 * | 8/2007 | Gelli ..... B65H 18/26 242/533.3 |
| 2007/0187022 | A1 | 8/2007 | Biagioni et al. |
| 2008/0029638 | A1 | 2/2008 | Fabio |
| 2008/0111017 | A1 | 5/2008 | Gambini |
| 2009/0302146 | A1 | 12/2009 | Morelli et al. |
| 2011/0017861 | A1 | 1/2011 | Nakanishi et al. |
| 2011/0133015 | A1 | 6/2011 | Gelli et al. |
| 2014/0084102 | A1 * | 3/2014 | Techlin ..... B65H 19/2292 242/520 |

FOREIGN PATENT DOCUMENTS

| | | | |
|---|---|---|---|
| CN | 201895975 | U | 7/2011 |
| EP | 0514226 | A1 | 11/1992 |
| EP | 0326528 | B1 | 9/1994 |
| EP | 0618159 | A2 | 10/1994 |
| EP | 1870516 | B1 | 8/2012 |
| EP | 2088106 | B1 | 8/2012 |
| JP | H0270642 | A | 3/1990 |
| JP | H03216469 | A | 9/1991 |
| JP | 6065350 | U | 9/1994 |
| JP | 2000109267 | A | 4/2000 |
| JP | 2001106395 | A | 4/2001 |
| JP | 3895469 | B2 | 3/2007 |
| JP | 4176247 | B2 | 11/2008 |
| JP | 4403526 | B2 | 1/2010 |
| JP | 4443267 | B2 | 3/2010 |

* cited by examiner

SURFACE WINDER

FIELD OF THE INVENTION

The present disclosure relates to an apparatus for the production of convolutely wound rolls of web material. The present disclosure more particularly relates to a rewinding machine for the production of rolls of convolutley wound web material, for example convolutely wound rolls of bath tissue and paper toweling, so as to obtain small rolls of bath tissue paper, all-purpose drying paper, and the like.

BACKGROUND OF THE INVENTION

Rewinding machines are used to produce convolutley wound rolls or "logs" of web material. Rewinders are used to convert large parent rolls of paper into retail sized rolls and bathroom tissue and paper towels. These rewinding machines typically wind a predetermined length of web material about a tubular winding core normally made of cardboard. These rolls or logs are then cut into a plurality of smaller-size rolls intended for commercial sale and consumer use. The tubular winding core section remains inside each convolutley wound roll of web material. In both cases the end product contains a tubular core made of material different from that forming the roll.

Rewinding machines are generally divided into two categories depending on the manner in which the winding movement is provided. The first type of rewinding machine, known as a central spindle rewinding machine (or center winder), a spindle supported on support elements between a pair of side walls receives a tubular winding core on which the roll or log is formed by means of rotation of the spindle which, for this purpose, is associated with drive means. The winding movement is therefore provided centrally by the spindle.

A second type of rewinding machine, known as a surface rewinding machine (or surface winder), the rotational movement of the tubular core on which the roll or log is formed is provided by peripheral members in the form of rollers or rotating cylinders and/or belts with which the roll or log is kept in contact during formation. Exemplary surface winders are disclosed in U.S. Pat. Nos. 3,630,462; 3,791,602; 4,541,583; 4,723,724; 4,828,195; 4,856,752; 4,909,452; 4,962,897; 5,104,155; 5,137,225; 5,226,611; 5,267,703; 5,285,979; 5,312,059; 5,368,252; 5,370,335; 5,402,960; 5,431,357; 5,505,405; 5,538,199; 5,542,622; 5,603,467; 5,769,352; 5,772,149; 6,286,419; 6,565,033; 6,595,458; 6,595,459; 6,648,266; 6,659,387; 6,698,681; 6,715,709; 6,729,572; 6,752,344; 6,752,345; 6,866,220; 7,293,736; 7,909,282; and EPO Patent Application No. 0514226 A1.

The surface winder is comprised of 3 principle winding rolls to perform the surface winding process. These rolls are the upper winding roll (UWR), lower winding roll (LWR), and rider roll (RR). The respective rolls are named due to where or how they contact a winding log. The UWR and LWR contact the winding log on the upper and lower portions respectively and the RR "rides" on the upper portion of the winding log as it increases in diameter as web material is wound thereabout. The winding log enters the surface winder and is adhesively attached to a web material to be wound thereabout in a region of compression disposed between the UWR and LWR. The winding log is initially rotated by the UWR in a region disposed between the UWR and a stationary core cradle and rotationally translates to a region disposed intermediate the rotating, but stationary, UWR and LWR (known as the winding nest region). The RR contacts the surface of the rotating winding log in the winding nest region and translates away from the UWR and LWR as web material continues to be convolutely wound about the winding log.

In an exemplary surface wind system, a web material is convolutely wound about a paperboard core of 1.5" to 1.7" diameter and of a length that corresponds to the width of the tissue parent roll which comes from the paper machine, usually in width from 65" to 155".

However useful, surface winders do have limitations. For example, the paperboard core that is used as the base for winding the web material is a hollow core and has a low bend modulus and is subject to radial deformation. This is particularly true as the volume of web material wound about the core is decreased. Convolutley wound rolls of web material that are sold in the retail commercial market have a target finally wound roll diameter. The target finally wound roll diameter is selected by manufacturers of such products to provide the appearance of a desirable and saleable product. Additionally, the physical characteristics of the web material wound about the core are constantly changing. These changes are necessitated by the economics for the production of such convolutely wound web material. For example, the material used to produce the underlying web material is a commodity. As the costs of the material increases, market dynamics require that the amount of material used to produce the web material be decreased. In other words, the density, or basis weight, of the web material is constantly decreasing.

Additionally, the web materials are constantly being modified by post formation treatments in the converting processes. Such post formation converting operations include, for example, embossing and calendaring. These post formation web material treatments will typically add thickness (or caliper) to the underlying web material. In order to maintain the appearance imparted to the web material by these converting operations, the winding process must prevent removing these desired characteristics from the winding process by winding the web materials about the cores with low tension. Winding a web material about a core in a low tension environment provides for a 'loose' wind. Thus, as the web material is wound about the core, the inherent bend modulus of the winding product disposed within the winding nest is not increased. In other words, the structural stability of the core is not increased in a low-tension winding process as would be observed in a winding process where a web material is wound about a core under high tension as the effective cross-section of the core/web material structure is not appreciably increased.

This drawback to winding a loosely wound web material about a core with a surface winding process typically results in a core/web material system that undergoes structural deformation within the winding nest. An exemplary structural deformation is shown in FIG. 1. Additionally, the core/web material system is often subject to instability within the winding nest that effectively causes the core/web material system to bounce between the UWR, LWR, and RR while disposed in the winding nest. An exemplary and representative bouncing core/web material system is shown in FIGS. 1A and 2.

Thus, there is a clearly defined need to increase the stability and structural strength of the core disposed within the winding nest of a surface winding system. Increasing the stability and structural strength of the core as well as the ensuing core/web material system in situations where the web material has a low basis weight, a high caliper, and processed under low tension can help provide a consumer acceptable convolutley finally wound web material product that meets current manufacturing financial and processing targets.

SUMMARY OF THE INVENTION

The present disclosure provides for a rewinding machine for convolutley winding a web material onto a core to form rolls of convolutley wound web material. The rewinding machine comprises a first winding drum rotatable at a first peripheral velocity, a second winding drum located in opposition to the first winding drum and rotatable at a second peripheral velocity, and a core support for gripping opposing ends of the core. The core traverses a path extending through a space defined between the first and second winding drums. The first and second winding drums cause the core to rotate in order to convolutley wind the web material thereabout to form the rolls of convolutley wound web material. The core support grips opposing ends of the core in the space and during winding of the web material about the core. The core support moves the core along a path between the first and second winding drums in which the web material is wound about the core. The core support further comprises a first rotatable pin having a corresponding first end and a corresponding second end capable of insertion into a first end of the core and a second rotatable pin having a corresponding first end and a corresponding second end capable of insertion into a second end of the core disposed distal to the first end of the core. The first and second rotatable pins both further comprises retaining means disposed upon the corresponding second end and are capable of providing fluidly sealing engagement with a respective interior portion of the core. The first rotatable pin further comprises a channel disposed therein. The channel provides fluid communication between a source of positive pressure disposed external to the first rotatable pin and the second end of the first rotatable pin. The source of positive pressure provides a positive pressure to the interior portion of the core through the channel from the first end of the first rotatable pin to the second end of the first rotatable pin when the second ends of both the first and second rotatable pins are in fluid sealing engagement with the interior portion of the core.

The present disclosure also provides for a rewinding machine for winding a web material onto a core to form rolls. The rewinding machine comprises a web supply path, along the web supply path, a first winding drum rotatable at a first peripheral velocity substantially corresponding to a web supply speed at which the web is supplied along the web supply path, the web being fed in contact with and around the first winding drum, a second winding drum located in opposition to the first winding drum and rotatable at a second peripheral velocity, and a core support for gripping opposing ends of the core. The core traverses a path extending through a space defined between the first and second winding drums, the space having opposite inlet side and outlet side, the web supply path extending through the space from the inlet side to the outlet side. The first and second winding drums cause the core to rotate in order to convolutley wind the web material thereabout to form the rolls of convolutley wound web material while the core is disposed within the space. The core support grips opposing ends of the core in the space and during winding of the web material about the core. The core support moves the core along a path between the first and second winding drums in which the web material is wound about the core. The core support further comprises a first rotatable pin having a corresponding first end and a corresponding second end capable of insertion into a first end of the core and a second rotatable pin having a corresponding first end and a corresponding second end capable of insertion into a second end of the core disposed distal to the first end of the core. The first and second rotatable pins both further comprise retaining means disposed upon the corresponding second end and being capable of providing fluidly sealing engagement with a respective interior portion of the core, the first rotatable pin further comprising a channel disposed therein. The channel provides fluid communication between a source of positive pressure disposed external to the first rotatable pin and the second end of the first rotatable pin. The source of positive pressure provides a positive pressure to the interior portion of the core through the channel from the first end of the first rotatable pin to the second end of the first rotatable pin when the second ends of both the first and second rotatable pins are in fluid sealing engagement with the interior portion of the core.

DETAILED DESCRIPTION

Figure 1:
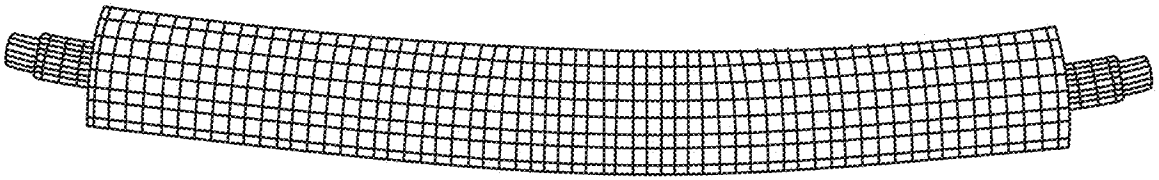
Fig. 1 PRIOR ART
FIG. 1 shows a plan view of an exemplary representation of a radially-deformed, unpressurized core that would typically be disposed within the winding nest of a surface winder as a web material is being convolutely wound thereabout.
Figure 1A:
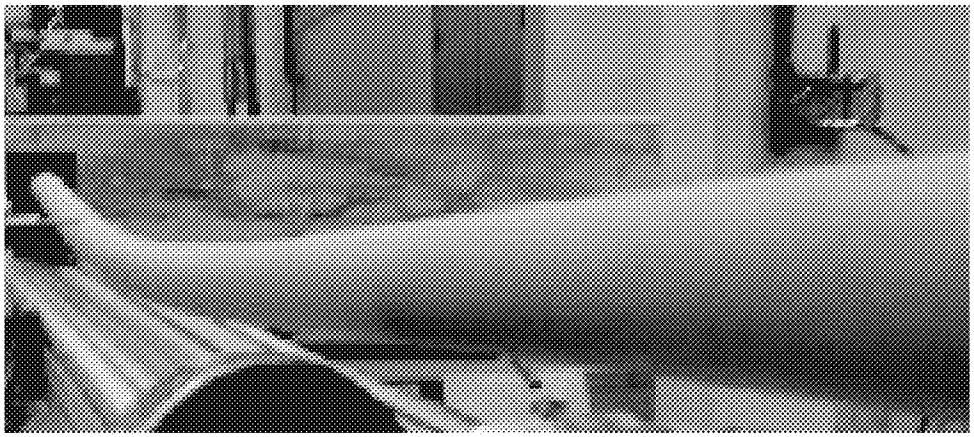
Fig. 1A PRIOR ART
FIG. 1A shows a perspective view of an exemplary radially-deformed, unpressurized core that would typically be disposed within the winding nest of a surface winder as a web material is being convolutely wound thereabout.
Figure 2:
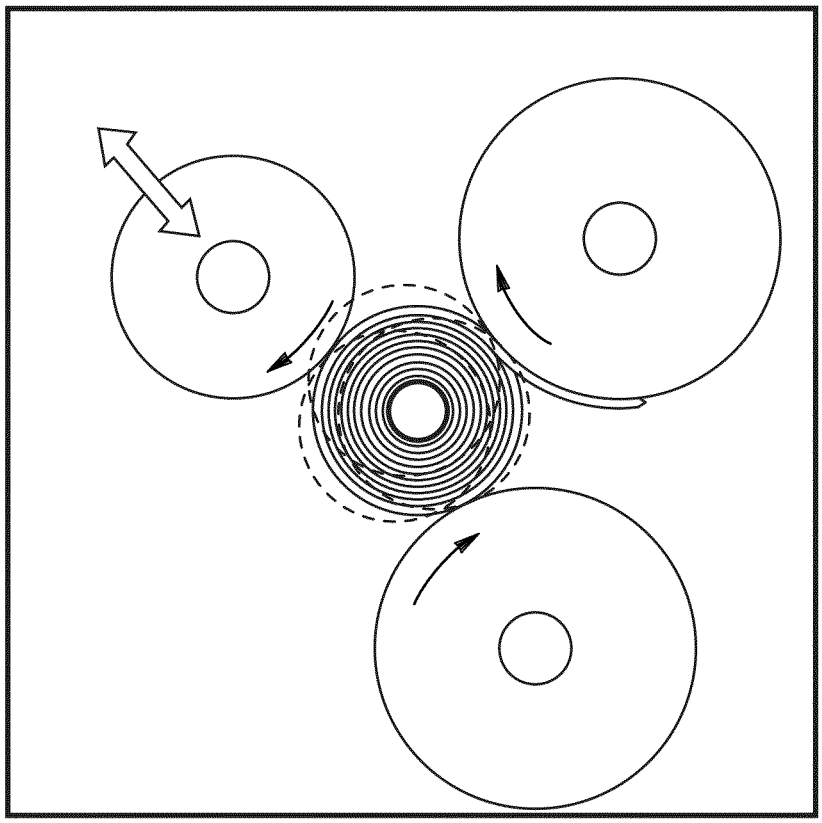
Fig. 2 PRIOR ART
FIG. 2 is a cross sectional view of an exemplary core/web material system exhibiting instability within the winding nest of an exemplary surface winder.

The basic elements of a surface rewinder 13 will be described hereinafter by referring first to FIGS. 3-4. Reference numerals 1 and 3 indicate rollers around which the web material N is fed from a supply parent roll (not shown) to the winding region of the surface rewinder 13. The web material N can be fed through a web perforation assembly (not shown). Such web perforation assemblies can comprise a non-rotating support (not shown) and a rotating cylinder (not shown). The non-rotating support can be provided with a counter-blade (not shown) which can cooperate with blades (not shown) carried by the cylinder to provide a line of perforations across the web material N.

Located downstream of a suitable perforation assembly are a first winder roller 15 (also known as upper winding roll or UWR 15), around which the web material is fed, and a second winder roller 17 (also known as lower winding roll or LWR 17). In the illustrated example, the two rollers 15 and 17 each rotate in a counter-clockwise direction. The cylindrical surfaces of rollers 15 and 17 define a nip 19 through which the web material N is fed. Numeral 21 designates a third roller (also known as rider roll or RR 21) also rotating in a counter-clockwise direction and supported by an arm 23 pivoted at 25 to the machine frame. The arm 23 can oscillate in the direction indicated by arrow G to allow the roller 21 to be lifted and lowered by an actuator (not shown). The winder rollers 15, 17 and 21 define the region of winding nest 22 where the winding of each log is completed, according to the procedures to be described hereinafter.

Located downstream of the three winder rollers is a chute 31 along which the completed logs L roll for the transfer thereof towards tail gluer means (not shown). Disposed upstream of the nip 19 is a curved surface or track 33 defined by a series of parallel arcuate strips 35. The strips 35 have pointed ends 36 directed toward the nip 19 and which terminate in annular slots 37 disposed within the surface of the lower winding roll 17. At the opposite end, the strips 35 terminate near the region at which the introduction of the cores A, A1, A2, etc. takes place, the latter being fed and inserted in the manner described hereinafter.

The curved surface or track 33 and the cylindrical surface of the first winder roller 15 define a channel 39 for the passage of the cores A, A1, A2, etc. The cross-section, i.e., the dimension of the channel 39 measured perpendicularly to the track 33, may be substantially uniform along the length of the strips and advantageously equal to, or slightly less than the diameter of the cores being used. This is achieved because the surface of the track 33 has a constant radius of curvature with its axis coincident with the axis of the first winder roller 15.

Arranged below the strips 35 which define the surface 33 is a rotary unit 41 carrying separation means 43, for the severance of the web material N, which cooperate with the cylindrical surface of the first winder roller 15. In this embodiment, the severing means can include pressers or pads 43 intended to exert a pressure, through a slight interference, against the surface of the first winder roller 15. The rotary unit 41 is made to rotate intermittently and in a clockwise direction. The pressers 43 move along a circular path C which has an axis coincident with the axis of rotation 45 of the unit 41 and almost tangent to (or making a slight interference with) the cylindrical surface of the first winder roller 15.

The cores are introduced into the channel 39 by means of a conveyor generally shown at 47. The conveyor includes a flexible continuous member 49 made up, for example, of a chain or a belt driven around transmission wheels (not shown), one of which can be motor-driven. Disposed at regular intervals on the flexible member 49 are pushers 57 each of which picks up a core A, A1, A2, etc. from a source of cores A, A1, A2, etc. The cores A, A1, A2, etc. are removed by the pushers 57 and lifted and transferred, through a gluing unit (not shown) but would be understood by one of skill in the art to include a tank of glue in which a series of discs can rotate. Such gluers are well-known and need not be described in greater detail.

Figure 3:
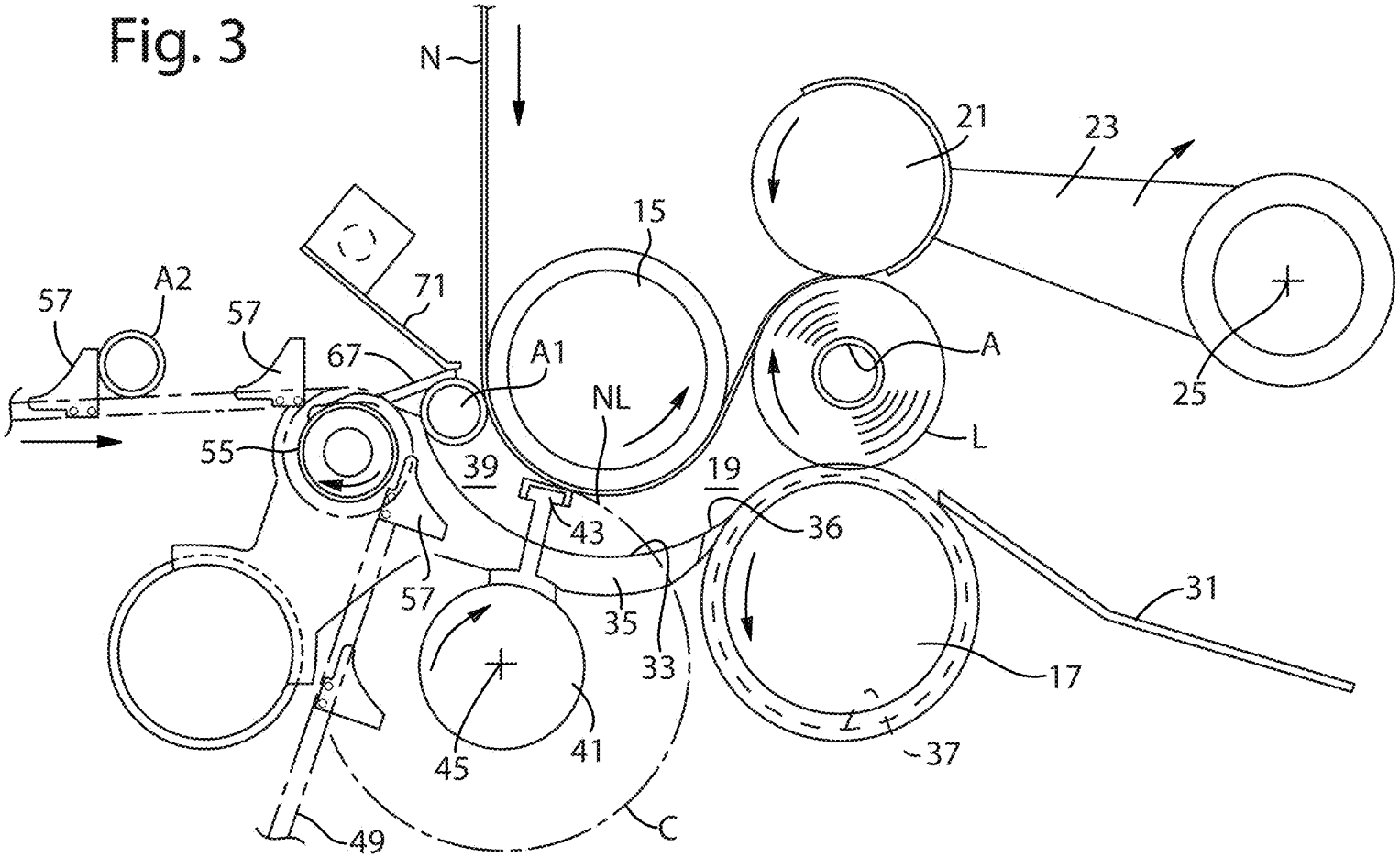
FIG. 3 is a cross-sectional view of the exemplary surface rewinding machine of FIG. 3 with a convolutely wound roll of web material ready to be ejected from the winding nest and a new core entering the winding cradle.
Figure 4:
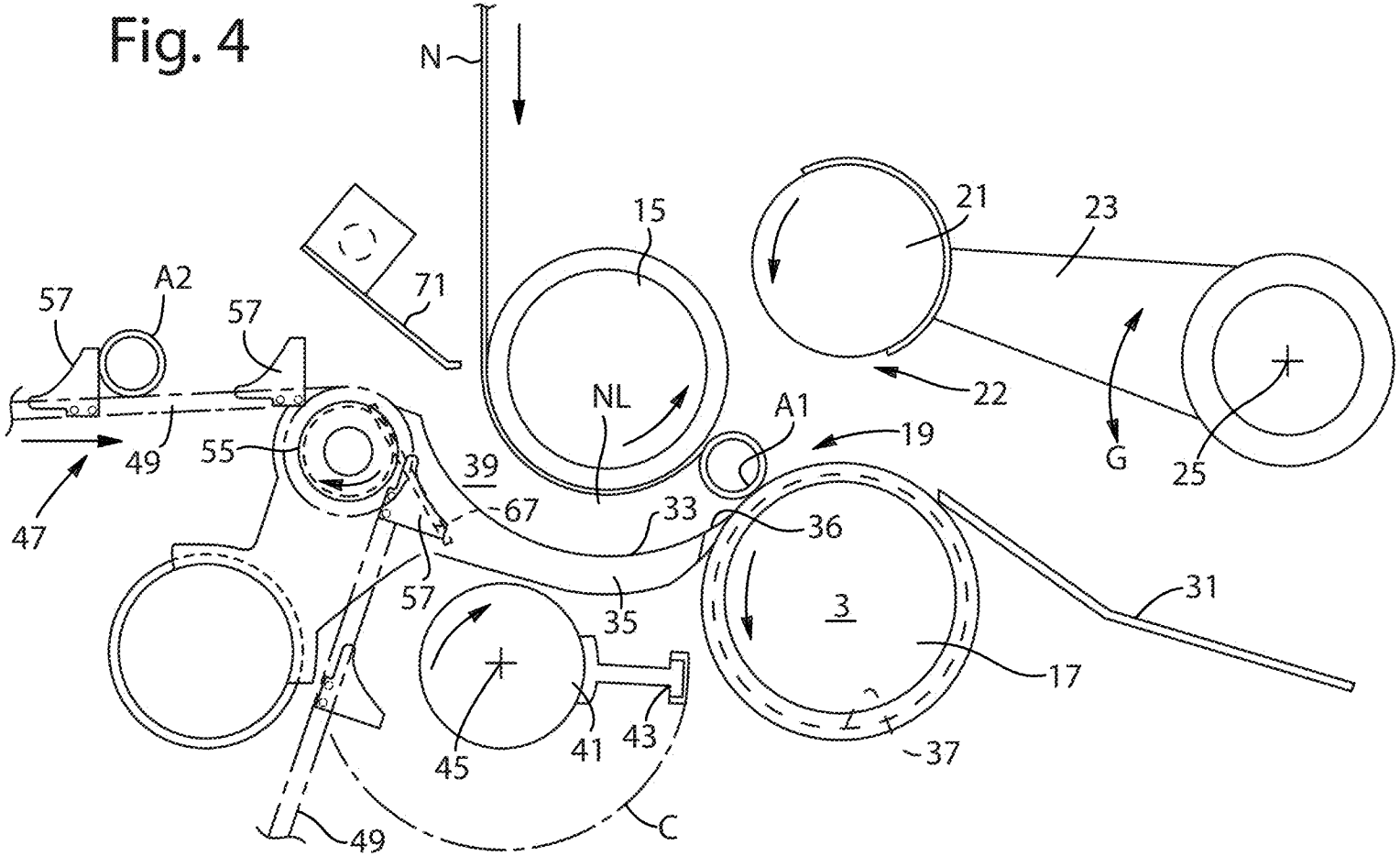
FIG. 4 is a cross-sectional view of an exemplary surface rewinding machine showing the introduction of a core in to the winding nest.
Figure 5:
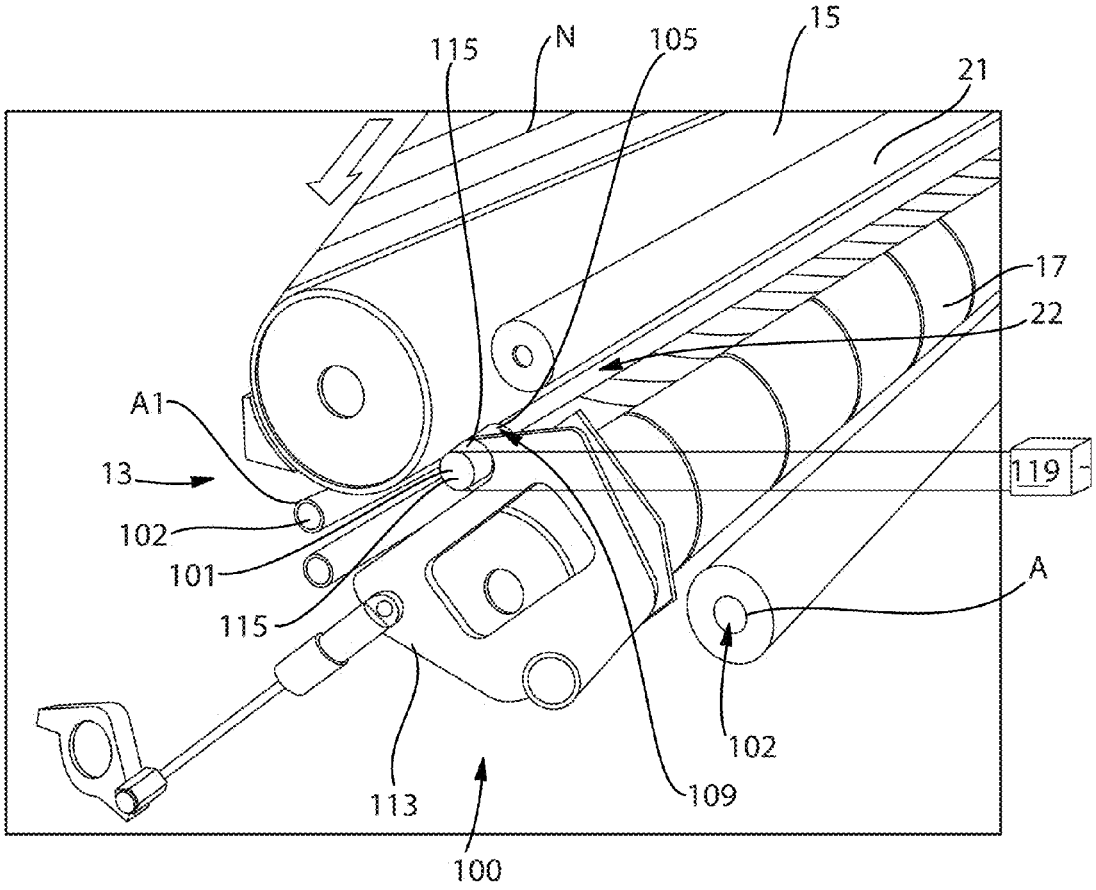
FIG. 5 is a perspective view of an exemplary surface winding machine showing an exemplary core support device.
Figure 6:
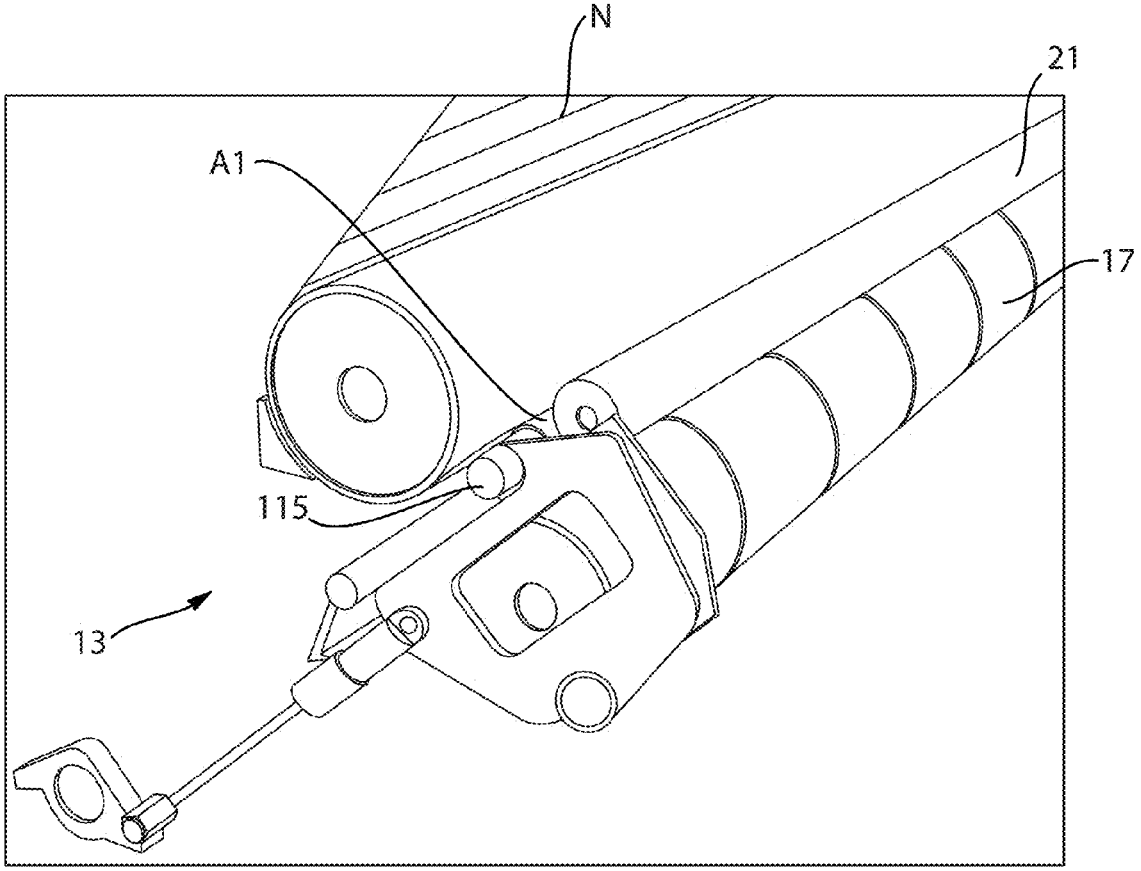
FIG. 6 is a perspective view of an exemplary surface winding machine showing a core support device in contacting engagement with a core disposed within the winding nest and having a web material convolutely wound thereabout.
Figure 7:
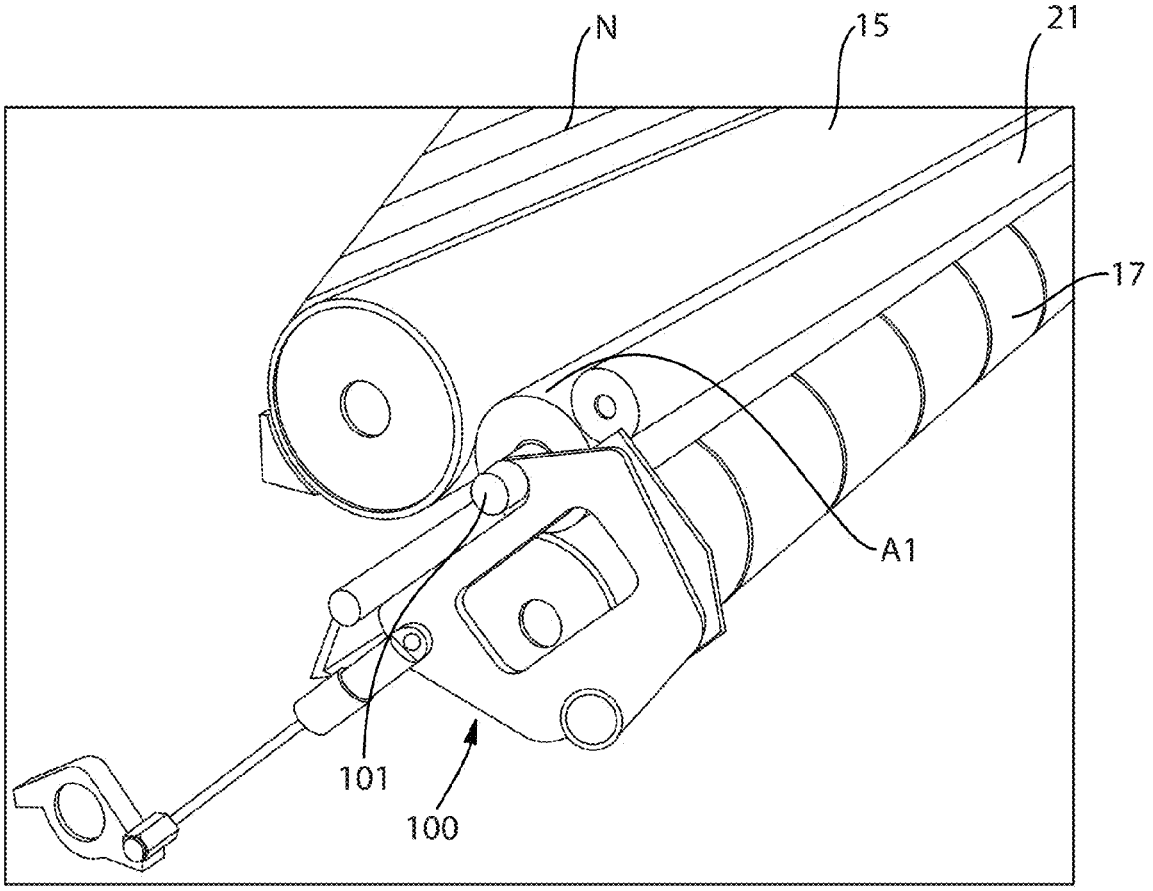
FIG. 7 is a perspective view of the exemplary surface winding machine of FIG. 6 showing a core support device in continuing contacting engagement with a core disposed within the winding nest and having a web material convolutely wound thereabout.
Figure 8:
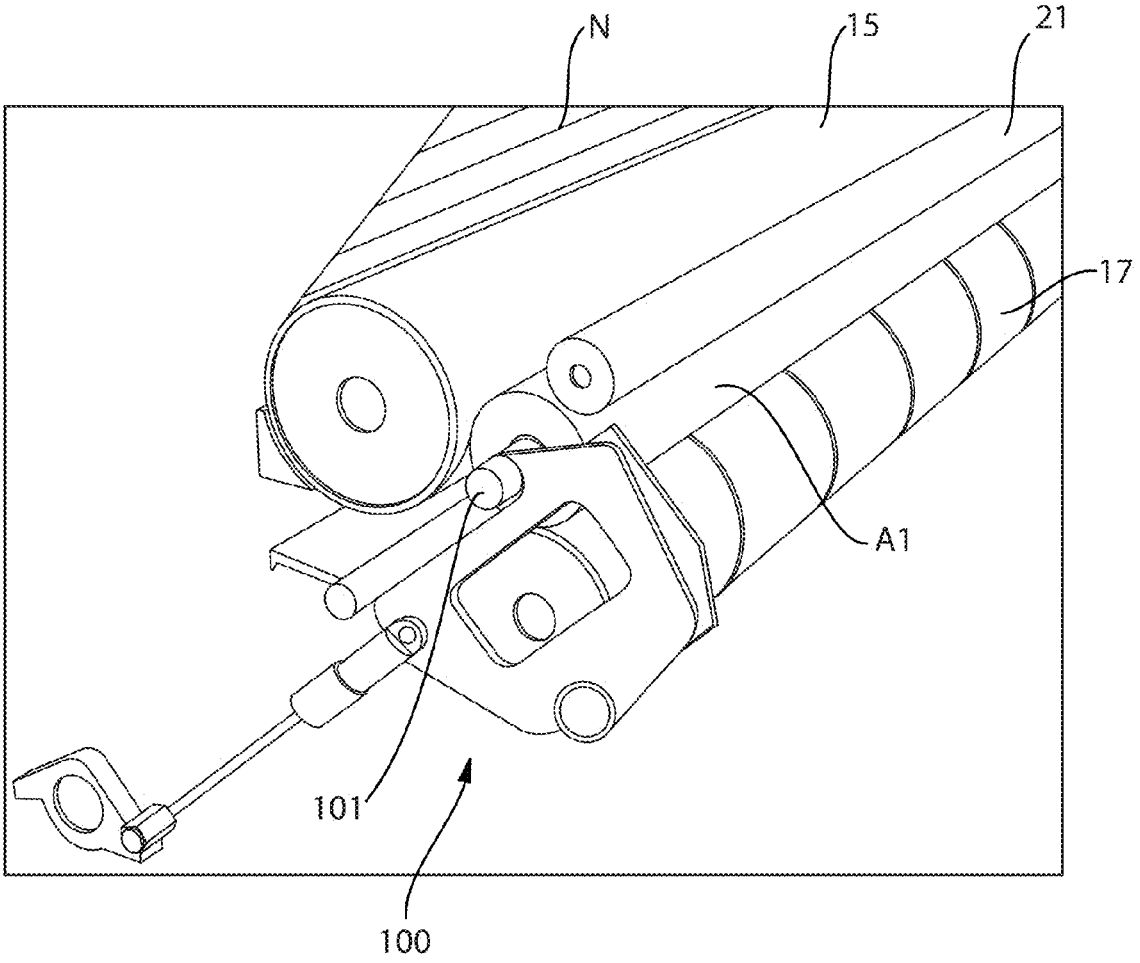
FIG. 8 is a perspective view of the exemplary surface winding machine of FIG. 6 showing a core support device in further continuing contacting engagement with a core disposed within the winding nest and having a web material convolutely wound thereabout.
Figure 9:
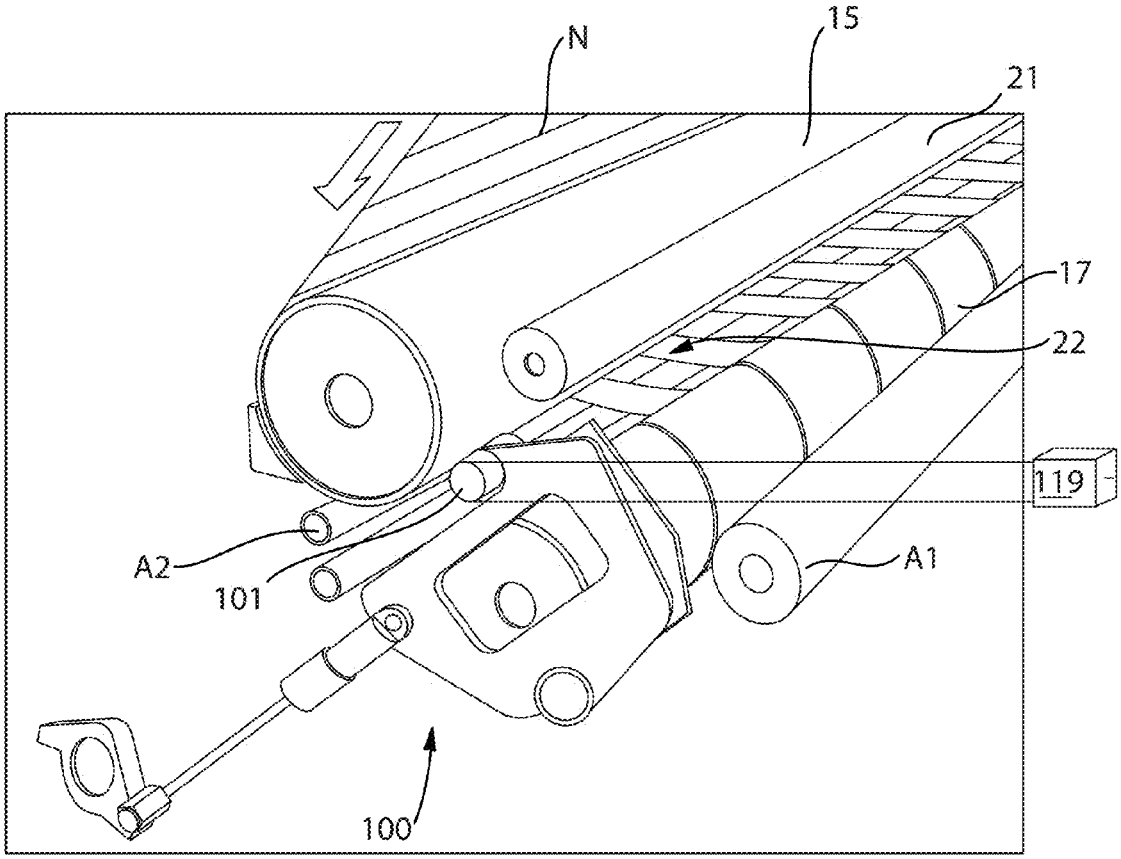
FIG. 9 is a perspective view of the exemplary surface winding machine of FIG. 6 showing a core support device in disassociated engagement with a core having a web material convolutely wound thereabout and previously disposed within the winding nest.

As shown in FIGS. 3-4, only a few cores A, A1, A2, etc. are shown, but it is to be understood that, under proper operating conditions, a respective core A is carried by each pusher 57 from the source of cores to the wheel 55, close to the mouth of the channel 39, to start the winding of each log, as will be described hereinafter.

FIG. 3 shows the final step of the winding of a log L. The first winder roller 15 and the third roller 21 rotate at a peripheral speed equal to the web material N feeding speed, while the second winder roller 17 rotates at a temporary lower peripheral speed to allow the completed log L to be moved towards the chute 31. At this stage, a new core A1 has been brought by the relevant pusher 57 to the entrance of channel 39. The insertion of the core A1 into the channel 39 may be carried out directly by the relevant pusher 57, or by an auxiliary pushing member, indicated by 67, rotating about the axis of wheel 55. This can (shown in the illustrated example) provide for the insertion of any core A to be performed with greater rapidity and precision, inasmuch as the insertion movement is unrelated to the movement of conveyor 47, the push member 67 being provided with an actuator which is independent of the actuator of the conveyor 47.

During this stage, the rotary unit 41 rotates about its axis 45 and the pressers 43 have already entered the channel 39 by passing between the strips 35 which define the surface 33. The peripheral speed of pressers 43 is less than that of first winder roller 15 and, therefore, also less than the speed of the web material N. In this way, the web material N is pressed between the two surfaces moving at different speeds. The effect of this difference in speed is a slowing down of the pinched portion with respect to the rest of the web material. This slowing down causes the web material to tear along a line of perforation that is closest to the point at which the web material N is pinched.

FIG. 3 shows the next stage in which the web material is torn off, giving rise to a new leading edge NL. The core A1 has, in the meantime, started to rotate owing to the contact thereof with the stationary surface 33 and with the rotating cylindrical surface of the winder roller 15. The core moves forward (i.e., downstream), therefore, by rolling along surface 33 at a speed equal to half the feeding speed of the web material N. However, one of skill in the art will understand that the first winding roller 15 can be controlled so that its peripheral velocity substantially corresponds to, is greater than, or is less than a supply speed of the web material N. The cross dimension of channel 39, which is slightly less than the diameter of the core A1 (the latter being typically made from pliable cardboard), allows a friction to be generated. This friction is necessary for the angular acceleration of the core from zero to the rolling speed, and the adhesion of the web material N to the surface of the core, on which glue has been spread by the gluing device 71. The latter effect is missing when the gluing of the core is not provided.

In FIG. 4, the core has left the surface 33 and is in contact with the surfaces of the winder rollers 15 and 17 which, by rotating at slightly different speeds (roller 17 being slower), cause the core to move forward through the nip 19. At the end of its advancement through the nip 19, the core A1 will be located between the three rollers 15, 17 and 21, in the winding nest 22 and the web material N will continue to wind up on the core A1, some turns thereof having already been wound during the transit of the core $A_1$ through the channel 39 and the nip 19. At this time the rotary unit 41 keeps on rotating in clockwise direction until the next operating cycle. Similarly, the auxiliary pushing member 67, which has continued to rotate simultaneously with the unit 41, is stopped. It is preferred that the space (the size of nip 19) defined between first winding roller 15 and second winder roller 17 correspond to a transverse size of the core A, A1, A2, etc.

In the partial perspective views shown in FIGS. 5-9, the rewinder can be provided with an apparatus 100 to stabilize the ends of core $A_1$ and the core/web material convolutely wound system as web material N is convolutely wound about core $A_1$ as it traverses though the winding nest. As shown in FIGS. 5-9, the respective cores A, A1, A2, etc. are advantageously moved along a path through surface rewinder 13 by providing a core support 100 for supporting each core A, A1, A2, etc., to assist in moving the respective cores A, A1, A2, etc. through the surface winder 13, as well as providing an adequate manner for controlling the rotation of the core A, A1, A2, etc. to wind a web material convolutley thereabout. In other words, a respective core A, A1, A2, etc. is motivated along a path that starts from a first position where the core support 100 contactingly engages a respective core A, A1, A2, etc. and terminates at the point where the core support 100 disengages from each of the rolls of convolutely wound web material L. The path of a core A, A1, A2, etc. through surface rewinder 13 is preferably generally linear, but can have any profile that is desirable by an end user to form a desired convolutley wound roll of web material L.

The core support 100 can also provide a manner for influencing the winding roll of web material as it bears continuously on at least one of the respective winding drums (i.e., UWR 15, LWR 17, and/or RR 21) forming winding nest 22 in the increasing portion of the working path in which the web material N is convolutely wound about the core A, A1, A2, etc. The core support 100 can influence the formation of the winding roll during formation as the roll having web material N convolutely wound thereabout bears continuously on the winding drums that define the winding nest 22 on at least two sides.

In one embodiment, at least one pair of opposed pins 101 can be operatively associated with the insides of each end of each of the tubular cores A, A1, A2, etc., as they are associated with each side of the set of winding drums forming winding nest 22. In other words, each pin 101 of core support 100 is associated with a respective end (e.g., a proximal end and a distal end) of each core A, A1, A2, etc. in any position as it traverses through surface winder 13. Each pin 101 is preferably provided as a cylindrical body on which core end 102 can be fitted with interference. The body of each pin 101 can be provided with a frustoconical free (second) end 105 for facilitating the insertion of each pin 101 into core end 102.

Figure 10:
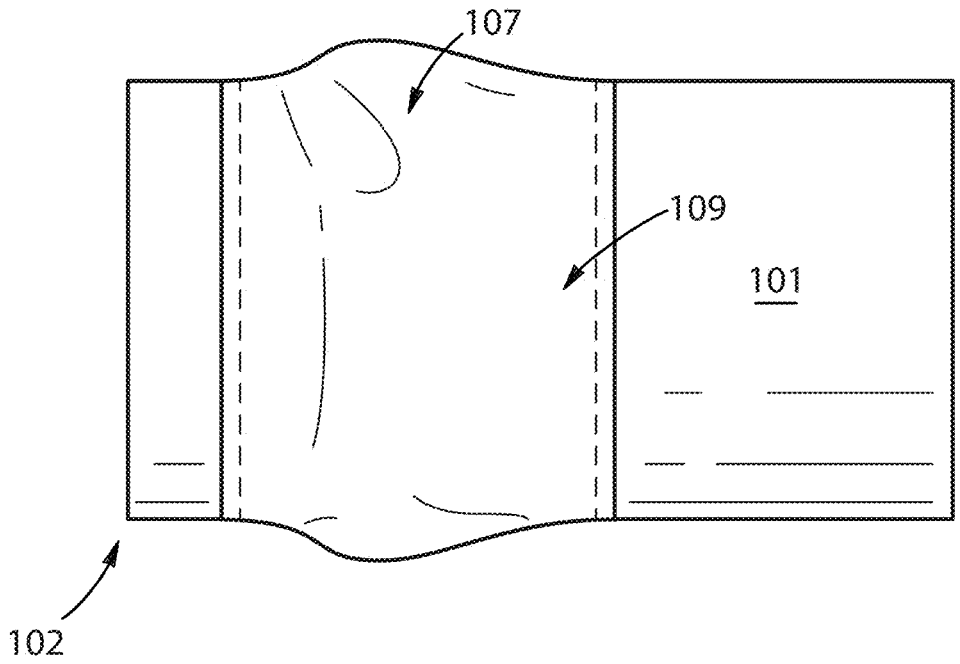
FIG. 10 is an elevational view of an exemplary pin having retaining means and suitable for use with a core support.
Figure 11:
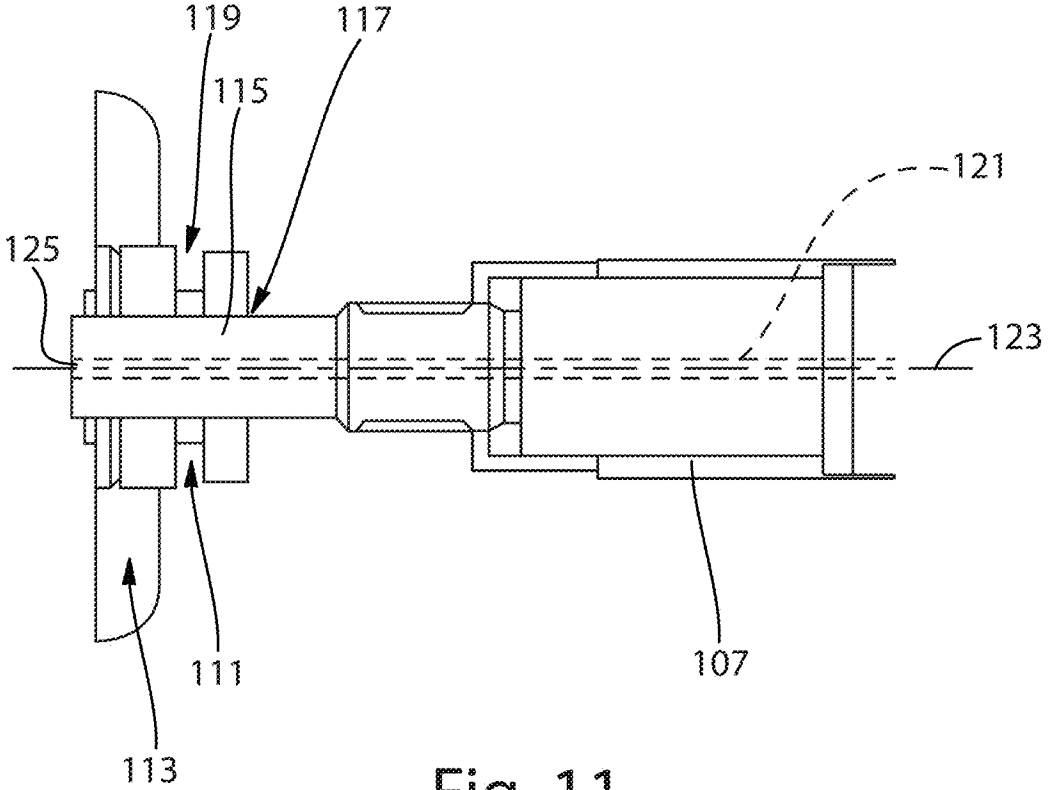
FIG. 11 is an elevational view of the exemplary pin of FIG. 10 showing the retaining means and a channel suitable for supplying a positive pressure from a source external to the pin to a position internal to the a core suitable for having a web material convolutely wound thereabout.

As shown in FIGS. 10-11, each exemplary pin 101 can optionally be provided with an annular projection capable of abutment with an internal portion of each respective core A, A1, A2, etc. One of skill in the art will recognize that the annular projection is but only one form of manner that can form retaining means 107 that can releasably attach and/or provide fluidly sealing engagement with a respective core A, A1, A2, etc. to the second end 105 of pin 101. By way of non-limiting example, at least one longitudinal channel, two opposed channels, or several uniformly spaced channels can be formed in the cylindrical body forming a respective pin 101. Additionally, each pin 101 can be provided and house retaining means 107 that releasably engages the inner surface of a tubular core A, A1, A2, etc. to ensure a firm grip of each respective core A, A1, A2, etc. by each pin 101 during movement of the respective core A, A1, A2, etc. through surface winder 13 and into winding nest 22. For example, retaining means 107 can comprise at least one resilient expansion device 109 that grips the inner surface of a tubular core A, A1, A2, etc. radially upon the expansion of the resilient expansion device 109 by the application of a pressure internal to resilient expansion device 109. Alternatively, each pin 101 can be provided with at least one blade-like element (not shown) disposed upon the second end 105 of pin 101 that can be expanded by a mechanical linkage system that can act to oppose slippage of a pin 101 out from within the tubular body of the core A, A1, A2, etc. Yet still alternatively, the second end 105 of each pin 101 can be provided with a temporary adhesive that is extruded from the second end 105 of each pin 101 to fixably and retainingly attach the inner portion of a respective core A, A1, A2, etc. to pin 101 that can be subsequently fractured upon the conclusion of the winding process to release the respective core A, A1, A2, etc. from the second end 105 of pin 101.

It is preferred that in one embodiment, independent means are provided for the controlled rotation of each end of a respective core A, A1, A2, etc. Further, each pair of opposed pins 101 are moved towards and away from the opposite ends of a core A, A1, A2, etc. cooperatively associated thereto as well as along the path of a respective core A, A1, A2, etc. through surface winder 13. Preferably, an operative connection can provided between core support 100 and any means associated with moving a core A, A1, A2, etc. through surface winder 13.

Core support 100 is generally provided with opposed carriages 109 provided on both sides of the core support 100 comprising the pin 101 and the respective manner 111 for rotating the pin 101. The carriages 109 are movable in a controlled manner along a movement axes generally parallel to the path of a core A, A1, A2, etc. through surface winder 13. Each pin 101 is movable in a controlled manner along a movement axes generally perpendicular to the path of a core A, A1, A2, etc. through surface winder 13.

According to one embodiment, the movement axes comprise, for each side of the surface winder 13, a pair of brackets 113 arranged parallel to one another. Each bracket 113 supports, in a freely slidable manner, sliding blocks 115 having a pin 101 disposed thereon are each affixed to a respective bracket 113. Each sliding block 115 is operatively connected to an actuating device (not shown) for causing it to slide on a respective transverse guide 117 by means of a respective sliding block 115. An exemplary actuating device can be provided as a cylinder and/or piston unit of the pneumatic or hydraulic type and operated in controlled manner. A respective transverse guide 117 can support, in a freely slidable manner, the carriage sliding block 115 carrying pin 101. The sliding block 115 is operatively connected to a device for its controlled movement within the transverse guide 117.

As would be understood by one of skill in the art, identical devices are provided for each side of the surface winder 13 and are arranged reflectively symmetrically with respect to the working plane of movement of each pin 101. For example, twin independent pins 101, controlled rotation means, movement means, and means for influencing the core A, A1, A2, etc. bearing on each roll comprising winding nest 22 (i.e., UWR 15, LWR 17, and/or RR 21) can be provided for each side or side wall of the surface winder 13.

With regard to the movement of each pin 101 of the pair of opposed pins 101 towards and away from a respective core A, A1, A2, etc., the apparatus for the movement of the core A, A1, A2, etc. can comprise further means for pulling the core A, A1, A2, etc. axially during the winding of the web material about core A, A1, A2, etc.

Each of the above-mentioned devices for moving the drums and the cores is operatively connected to a corresponding control device which, for convenience of illustration has been indicated by a single reference element, indicated 119. Control devices 119 suitable to rotate each pin 101 can be controlled by one or more control devices, preferably with feedback. In particular, a motor (not shown) for rotating the pins 101 can operated in controlled manner, for example, by a signal proportional to the tension exerted on the web material N, detected by a load cell provided in pin 101 and fed back to the control device 119. According to one embodiment, the control imposed on the operation of the pin 101 can constitute a reference for the operation, in synchronism or out of phase therewith, of the surface winder 13, conveyor 47, and/or any other incorporated core-supply device, as well as of the means for gripping, rotating and moving the core A, A1, A2, etc. In particular, UWR 15 can be operated in controlled manner, advantageously with feedback of its rate of rotation, so as to achieve a peripheral velocity thereof, that is, a speed of its curved surface in contact with the web material N, substantially corresponding to, greater than, or less than the speed imposed on the web material N by the UWR 15 (e.g., a supply speed). Additionally, the LWR 17 is also driven in controlled manner with feedback of its rate of rotation so as to achieve a peripheral velocity thereof substantially corresponding to, greater than, or less than the supply speed of the web material N. By controlled regulation of the relative speeds of the UWR 15 and LWR 17, it is possible to regulate the winding of the web material N onto a respective core A, A1, A2, etc. and consequently the consistency of the convolutley wound roll of web material.

With regard to the core support 100, there is provision for their controlled operation with speed feedback which, with a knowledge of the thickness of the web material N, for example, because it is predefined or is detected by suitable transducers, can achieve a peripheral velocity of the pin 101 being wound substantially corresponding to, greater than or less than the supply speed of the web material N. A controlled enlargement or increase of the convolutley winding roll of web material N is thus achieved. With a speed substantially corresponding to the supply speed of web material N, a convolutley wound roll of web material having uniform compactness can be obtained, with a speed greater than the supply speed, a small, tight and compact roll is obtained, and with a slower speed, a soft and voluminous convolutely wound roll of web material can be obtained. According to one embodiment, a device can be interposed between the pin 101 and the manner for the controlled rotation of the pin 101 for detecting the force transmitted to the core A, A1, A2, etc. This device for detecting forces transmitted to the core A, A1, A2, etc. is preferably operatively connected to the manner for rotating the pin 101 and the control device 119. In particular, by virtue of the device which detects the forces transmitted to the core A, A1, A2, etc. by the means for its rotation, it is possible to detect the occurrence of torsional, and principally flexural, vibrations, during the winding of the web material N upon core A, A1, A2, etc. The provision of independent means for the controlled rotation of each end of the core A, A1, A2, etc. can advantageously permit a synchronized or out-of-phase movement of the two ends of the core A, A1, A2, etc. in order to control the axial uniformity of the winding, and to actively damp the vibrations produced in the growing convolutely winding roll of web material. Further, the manner for rotating the pin 101 is advantageously operatively connected to the control device 119 so as automatically regulate the uniformity of the compactness of the winding roll upon variations of the speed of supply of the web material N.

While the previous description provides a device that can partially control the motion of a respective core A, A1, A2, etc. through a surface winder 13 and in the winding nest 22, significant issues regarding the stability of the core A, A1, A2, etc. (as discussed supra) remained. To be noted, the core A, A1, A2, etc. can still experience an outward flexural radial movement (bending moment). Without desiring to be bound by theory, it is believed that the inherent bend (elastic) modulus of the core A, A1, A2, etc. due to its construction could be perceived as unacceptably low thereby causing the apparent radial harmonic deflection. Thus, it is clearly beneficial to increase the overall modulus value of the core A, A1, A2, etc. in a manner that reduces this observed outward radial movement of the core A, A1, A2, etc.

Net—It was surprisingly found that the introduction of positive pressure into the core A, A1, A2, etc. when opposed pins 101 were disposed within a respective core A, A1, A2, etc., in retaining engagement (e.g., locked onto the inside surface) of a respective core A, A1, A2, etc. and/or in fluidly sealing engagement to the respective core A, A1, A2, etc. was found to accomplished this result.

By way of non-limiting example, core support 100 having two pins 101 as shown in FIG. 10 can be provided designed to support a core A, A1, A2, etc. Each pin 101 can be mounted on a suitable bearing or other similar device that facilitates rotational movement of a respective pin 101 connectively engaged thereto to about longitudinal axis 123. An optional control device 119 can provide direct engagement with a motor or other device that can provide pin 101 with rotational motion about axis 123 if so required. By way of non-limiting example, such direct positioning, retaining, and/or fluidly sealing rotational motive engagement can be provided by way of a transmission or a gear box assembly. Alternatively, control device 119 can provide indirect engagement with a motor or other device that can provide pin 101 with rotational motion about axis 123. By way of non-limiting example, indirect engagement could include a belt drive or chain-driven execution as would be known to one of skill in the art. In any regard, the pins 101 of core support 100 supports a core A, A1, A2, etc. from the inside of the core A, A1, A2, etc. as discussed supra.

As shown in FIG. 11, a respective one pin 101 of core support 100 can be provided in fluid communication with a suitable source of a positive pressure 125 and the positive pressure being consequently directed therethrough by providing an exemplary channel 121 (or channels) therein. By way of non-limiting example and as may be required, positive pressure from a suitable source of positive pressure 125 can be fluidly communicated to pin 101 through the use of a pressure regulator connected to a first end of one pin 101 and fluidly communicated to a distal end of pin 101 through channel 121 and then fluidly communicated to provide positive pressure 125 internally to core A, A1, A2, etc. In any regard, the positive pressure 125 that is provided internally to core A, A1, A2, etc. can be facilitated by pins 101 merely disposed within core A, A1, A2, etc. or provided in a fashion that provides pins 101 that are in retaining engagement with the internal surface of a respective core A, A1, A2, etc. and/or sealably engaged to the respective core A, A1, A2, etc. As discussed supra, each pin 101 that can be retainingly and/or fluidly sealingly engaged internally with core A, A1, A2, etc. can be provided with retaining means 107 that can suitably engage at least an inner portion of core A, A1, A2, etc. to provide pneumatic sealing engagement with core A, A1, A2, etc. so that any positive pressure provided internally to core A, A1, A2, etc. remains therein.

Figure 12:
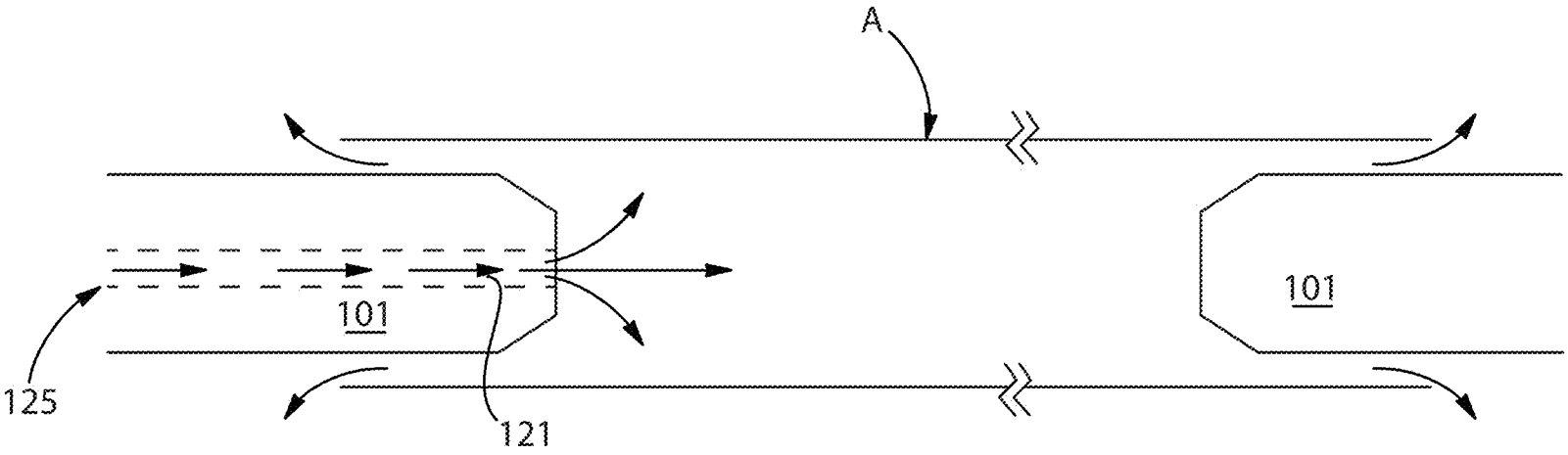
FIG. 12 is a plan view of an exemplary core support device inserted into a core but not provided with retaining or sealing means.

In the non-limiting but exemplary embodiment shown in FIG. 12, pin 101 can be disposed within core A, A1, A2, etc. but not be provided with contacting, retaining, and/or fluidly sealing engagement with core A, A1, A2, etc. In this embodiment, a positive pressure emanating from a source of positive pressure 125 can be fluidly communicated to an internal portion of core A, A1, A2, etc. through channel 121 originating a first end of pin 101 and terminating at a second end of pin 101 disposed distal thereto. Thus, the positive pressure communicated to the internal portion of core A, A1, A2, etc. through channel 121 can be allowed to be removed from the central portion of core A, A1, A2, etc. at a defined rate that is determined by the amount of interference presented in the region where pin 101 is engaged within core A, A1, A2, etc. By way of example, a large amount of space disposed between the outer surface of pin 101 and the internal surface of core A, A1, A2, etc. could ostensibly facilitate the egress of positive pressure disposed within the internal portion of respective core A, A1, A2, etc. between the opposed pins 101. Alternatively, a small amount of space disposed between the outer surface of pin 101 and the internal surface of core A, A1, A2, etc. could ostensibly retard the egress of positive pressure disposed within the internal portion of respective core A, A1, A2, etc. between the opposed pins 101.

In the event the amount of positive pressure provided by a source of positive pressure 125 through channel 121 disposed within pin 101 into the inner volume of a large amount of space disposed between the outer surface of pin 101 and the internal surface of core A, A1, A2, etc. could ostensibly facilitate the egress of positive pressure disposed within the internal portion of respective core A, A1, A2, etc. disposed between the opposed pins 101 exceeds the volume of positive pressure dismissed through the gap disposed between the outer surface of pin 101 and the inner surface of core A, A1, A2, etc. disposed thereabout, the positive pressure disposed within core A, A1, A2, etc. could function as a pseudo-air bearing in the region disposed between the outer surface of pin 101 and the inner surface of core A, A1, A2, etc.

It was found that such a construction could eliminate the need for a respective control device 119 required to rotate pin 101 as well as the need to retainingly engage and/or sealably engage the outer surface of pin 101 and the internal surface of core A, A1, A2, etc. This arrangement would be observed by one of skill in the art to provide the increased modulus of the core A, A1, A2, etc., provide increased control of core A, A1, A2, etc. while core A, A1, A2, etc. is disposed in winding nest 19 and at the same time reduce the complexity of providing a motive force required to rotate pin 101. This arrangement can make use of currently marketed commercial equipment and retro-fit kits by minimizing the amount of work required to provide the stabilization benefits desired by the owner/operator of surface rewind equipment. At the same time, it could be considered a simplification of the currently marketed commercial equipment and retro-fit kits by eliminating the need for extra structure and mechanical linkages (e.g., pin 101 drive assemblies) and still provide the stabilization benefits desired by the owner/operator of surface rewind equipment.

In a non-limiting but exemplary embodiment, a respective retaining means 107 can sealingly engage each respective pin 101 of core support 100 cooperatively associated thereto internally to core A, A1, A2, etc. through the use of a resilient expansion device housed in at least one longitudinal channel provided in the pin, the expansion device comprising at least one bladed element acting to oppose slipping-out of the pin from contacting engagement with an interior portion of the core A, A1, A2, etc. One non-limiting example of a resilient expansion device suitable for use as retaining means 107 is an exemplary cylindrical urethane sleeve. A retaining means 107 provided in the form of a cylindrical urethane sleeve (as shown in FIG. 10) can be forcibly deflected radially outward from the surface of each respective pin 101 relative to the longitudinal axis 123 of the respective pin 101. Thus, positive pressure 125 can then be brought into, and remain, in sealed contacting engagement with the inner portion of core A, A1, A2, etc.

It should be realized by one of skill in the art that the positive pressure presented to the inner portion of a respective core A, A1, A2, etc. is preferably placed in sealing engagement to the inner portion of a respective core A, A1, A2, etc. however, this is not necessarily the case. It may be useful to present the positive pressure to the inner portion of the respective core A, A1, A2, etc. in a situation where the pin 101 is not in fluidly sealing engagement with the inner portion of a respective core A, A1, A2, etc. This can effectively temporarily pressurize the core A, A1, A2, etc. during the convolute winding of a web material thereabout.

Figure 13:
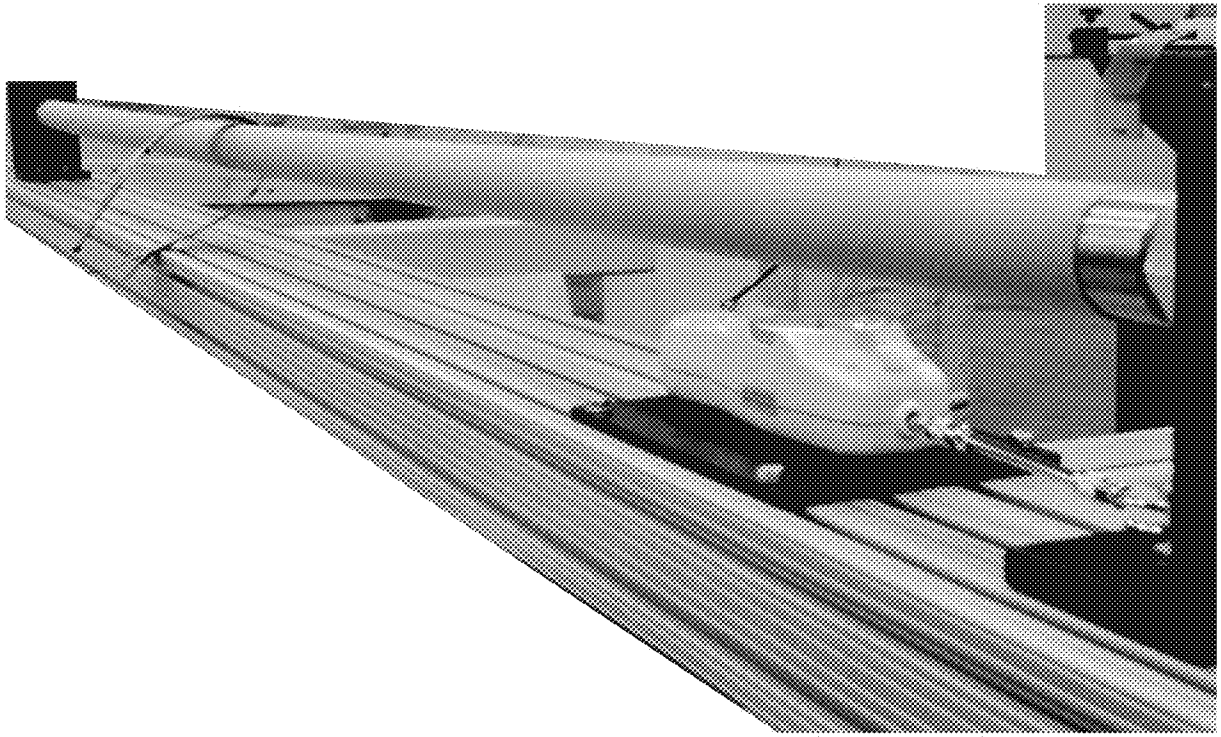
FIG. 13 is a perspective view of an exemplary radially un-deformed, pressurized core that would typically be disposed within the winding nest of a surface winder as a web material is being convolutely wound thereabout according to the present disclosure; and, FIG. 14 is a plan view of the simply-supported boundary conditions supporting a beam model.

As shown in FIG. 13 and without desiring to be bound by theory, it is believed that providing a positive pressure 125 into the internal portion of a sealed core A, A1, A2, etc. and maintaining such positive pressure 125 within the core during the winding of a web material thereabout can effectively temporarily increase the inherent modulus of elasticity (elastic modulus) of the core A, A1, A2, etc. relative to the same core A, A1, A2, etc. provided without such internal pressurization. For example, a core A, A1, A2, etc. can be provided with a first elastic modulus when the web Material N is wound about the core A, A1, A2, etc. and have a second elastic modulus after the web material has been convolutely wound about the core A, A1, A2, etc. In most circumstances, the first elastic modulus will be greater than the second elastic modulus. Further the second elastic modulus is likely equal to the elastic modulus prior to the convolute winding of web material N about the core A, A1, A2, etc. A discussion of the increased elastic modulus of a core A, A1, A2, etc. in accordance with the present disclosure is discussed infra.

Figure 14:
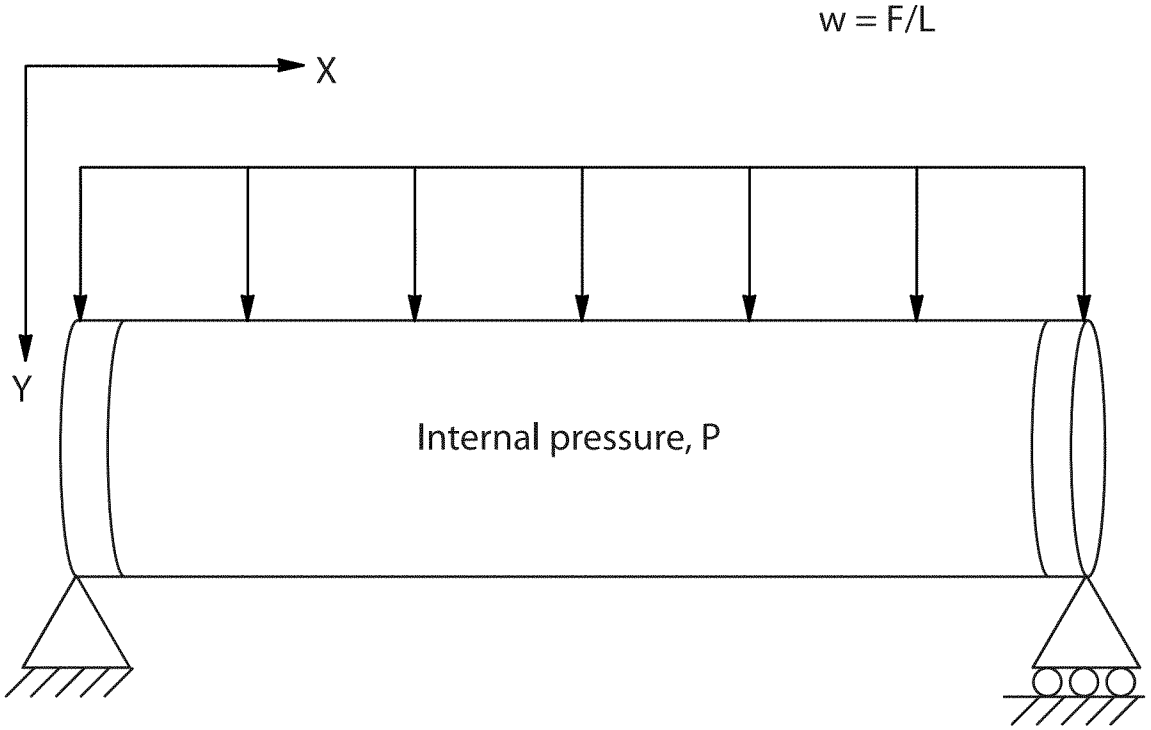

Without desiring to be bound by theory, one of skill in the art will recognize that modified conventional beam theory could be applied to understand the deflection of an internally pressurized core A, A1, A2, etc. The goal is to calculate the magnitudes of deflection and stress at the onset of wrinkling (i.e., wrinkling is understood by those of skill in the art to be the formation of furrows, ridges, or creases on a normally smooth surface, caused by crumpling, folding, or shrinking). For purposes of this discussion, the core A, A1, A2, etc. being analyzed by the conventional beam theory model used within the derivation is provided as an internally pressurized circular-cylindrical, closed-end tube. Inflatable theory provides for a representative pretension force to replace the internal pressure provided within core A, A1, A2, etc. that acts upon the respective pins 101 in the analysis. This pretension force creates a stress that opposes the compressive bending stress and adds to the bending tensile stress. Wrinkling occurs when the compressive portion of bending stress exceeds the pretension stress. FIG. 14 shows the pretension stress distribution in a model beam subject to bending.

In thin structures, resultant properties are often used by integrating over the thickness. If I* is the resultant area moment of inertia of a circular tube and E* is the resultant elastic modulus, the governing equation for the traditional beam bending problem is given by:

$$\frac{d^2y}{dx^2} = \frac{M(x)}{E^* I^*} \qquad \text{Eq. (1)}$$

where $I^*=\pi r^3$. The above equation can be integrated to determine deflection, y, for the pinned-roller boundary conditions as shown in FIG. 14, as:

$$y = \frac{w}{24E^*\pi r3}(2Lx^3 - x^4 - L^3x). \qquad \text{Eq. (2)}$$

For discussion purposes only, consider a pressurized tube, as illustrated in FIG. 14, under a distributed load. In the conventional beam theory, the transverse load creates bending stress that is linear across the cross-section. Due to the internal pressure and the transverse load, the tube has tensile stress between $\sigma_m$ and $\sigma_0$. As the bending moment increases, a portion of the tube may reach zero stress because the core A, A1, A2, etc. wall cannot resist much compressive force. The zero-stress portion of the tube (i.e., the core A, A1, A2, etc.) is denoted by angle $\theta_0$. Here, the failure of the structure is defined when $\theta_0>0$, which represents the onset of wrinkling.

Wrinkle length is the length of the tube at which wrinkling first occurs for a given loading and geometric conditions. This length depends on the moment necessary to initiate wrinkling. For a given angle $\theta_0$, the magnitude of the maximum stress is determined from the balance of the longitudinal forces:

$$\sigma_m = \frac{\pi pr(1+\cos\theta_0)}{2t[\sin\theta_0 + (\pi-\theta_0)\cdot\cos\theta_0]} \qquad \text{Eq. (3)}$$

where r and t are the radius and the thickness of the tube, respectively, and p represents the internal pressure present in the tube. Since bending stress is generated due to the bending moment, the maximum stress can also be expressed in terms of the bending moment, M, as:

$$\sigma_m = \frac{2M(1+\cos\theta_0)}{tr^2(2\pi - 2\theta_0 + \sin 2\theta_0)} \qquad \text{Eq. (4)}$$

By combining these two equations and using the failure criterion of $\theta_0=0$, the bending moment necessary to initiate wrinkling can be obtained as:

$$M = \frac{p\pi r^3}{2} \qquad \text{Eq. (5)}$$

When a constantly distributed force is applied, the maximum bending moment occurs in the middle of the length. By equating the maximum bending moment with Eq. (5), we have:

$$M_{max} = \frac{wL^2}{8} = \frac{p\pi r^3}{2} \qquad \text{Eq. (6)}$$

Solving for L and setting the load, w=F/L, yields the general expression for wrinkle length as:

$$L_{wr} = \frac{4p\pi r^3}{F} \qquad \text{Eq. (7)}$$

The wrinkle length is the length at which wrinkling first occurs in an inflated tube subject to bending, for a given pressure. As expected, the wrinkle length will be reduced for a higher loading force, F, and is proportional to the internal pressure and the tube radius. The tube radius, r, is the largest contributing factor to the wrinkle length for these conditions. Therefore, it can be reasonably provided that the presence of a positive pressure within the core A, A1, A2, etc. having a web material N convolutely thereabout while disposed within the winding nest 22 of a surface rewinder 13 can increase the bend modulus of the core A, A1, A2, etc. and reduce the bending of the core A, A1, A2, etc. as shown in FIG. 1. Therefore, it could be reasonably understood by one of skill in the art that the internal pressurization of core A, A1, A2, etc. can provide for a better quality wind of materials about core A, A1, A2, etc. by increasing the stability and structural strength of the core A, A1, A2, etc. disposed within the winding nest 22 of a surface winding system 13. The increased stability and structural strength of the core A, A1, A2, etc. as well as the ensuing core A, A1, A2, etc./web material N system in situations where the web material N has a low basis weight, a high caliper, and is processed under low tension can provide a consumer acceptable convolutley finally wound web material product that meets current manufacturing financial and processing targets.

A typical core having a length of about 10 feet can be formed from a process that produces cores having a single or multi-ply (e.g., more than 2 plies) construction. A typical core having a length of 100 inches can be formed from a material having a basis weight ranging from about 10 pounds/1000 square feet to about 100 pounds/1000 square feet, or ranging from about 30 pounds/1000 square feet to about 70 pounds/1000 square feet, or ranging from about 40 pounds/1000 square feet to about 60 pounds/1000 square feet, or ranging from about 50 pounds/1000 square feet to about 55 pounds/1000 square feet. It is believed that a typical core having a length of 100 inches can be formed from a material having a thickness ranging from 0.001 inch to about 0.030 inch, or from about 0.005 inch to about 0.0225 inch, or from about 0.010 inch to about 0.020 inch, or from about 0.014 inch to about 0.018 inch. A typical core having a length of about 100 inches will have an average CD elastic modulus of about 917 MPa, or less than about 500 MPa, or less than about 250 MPa and an average MD elastic modulus of about 3000 MPa, or less than about 2000 MPa, or less than about 1000 MPa. A typical core having a length of about 100 inches will have a ratio of basis weight to CD elastic modulus value ranging from about 0.105 $lb/in^2$ to about 0.637 $lb/in^2$, or from about 0.142 $lb/in^2$ to about 0.450 $lb/in^2$, or from about 0.201 $lb/in^2$ to about 0.333 $lb/in^2$. A typical core having a length of about 100 inches will have a ratio of basis weight to MD elastic modulus value ranging from about 0.058 $lb/in^2$ to about 0.318 $lb/in^2$, or from about 0.071 $lb/in^2$ to about 0.225 $lb/in^2$, or from about 0.101 $lb/in^2$ to about 0.184 $lb/in^2$. It was surprisingly found that a core used for the production of Bounty® paper toweling and/or Charmin® bath tissue as capable of withstanding an internal pressure of at least about 60 psi without undergoing a catastrophic failure. Thus, one of skill in the art could apply any internal pressure to core A, A1, A2, etc. that can provide the desired value of modulus of core A, A1, A2, etc. that reduces the vibration and/or motion of the core A, A1, A2, etc. and/or a core A, A1, A2, etc. having a web substrate wound thereabout while it is disposed within the winding nest of a surface winder.

It was surprisingly found that the pressurization of the core A, A1, A2, etc. can also provide other significant benefits. For example, it is believed that one of skill in the art could provide the source of positive pressure 125 with attributes that would enable the source of positive pressure 125 to function as a delivery vehicle of desired or desirable chemistries and/or materials into the interior portion of the core A, A1, A2, etc. By way of non-limiting example, the source of positive pressure 125 could be fluidly connected to a source of atomized particles that contain efficacious amounts of a chemistry that could be deposited within the core A, A1, A2, etc. If for example, it was desired to provide a fragrance into the inner portion of the core A, A1, A2, etc., an appropriate fragrant chemistry could be introduced into the fluid stream that is presented into the core A, A1, A2, etc. by the source of positive pressure 125. Such an appropriate fragrant chemistry could appropriately attach to the material forming the interior portion of the core A, A1, A2, etc. on a semi-permanent or permanent basis or could just merely reside within the inner portion of the core A, A1, A2, etc. temporarily. In the event of a temporary residence of a fragrant chemistry, such fragrant chemistry could be contained within the inner portion of the core A, A1, A2, etc. by suitable manufacturing process that could effectively seal such chemistry within the core A, A1, A2, etc.

Naturally, any form of chemistry can be placed in contacting engagement with the source of positive pressure 125 as may be required. Alternative non-limiting example of chemistry that could be placed in fluid engagement with the source of positive pressure 125 could include medicaments, opacifying agents, optical enhancing agents, optical brighteners, surface energy modifiers, inks, dyes, softening agents, cleaning agents, dermatological solutions, wetness indicators, adhesives, botanical compounds, skin benefit agents, medicinal agents, lotions, fabric care agents, dishwashing agents, carpet care agents, surface care agents, hair care agents, air care agents, water, steam, actives comprising a surfactant selected from the group consisting of: anionic surfactants, cationic surfactants, nonionic surfactants, zwitterionic surfactants, and amphoteric surfactants, antioxidants, UV agents, dispersants, water, steam, disintegrants, antimicrobial agents, antibacterial agents, oxidizing agents, reducing agents, handling/release agents, perfume agents, perfumes, scents, oils, waxes, emulsifiers, dissolvable films, edible dissolvable films containing drugs, pharmaceuticals and/or flavorants, and drugs selected from the group consisting of: analgesics, anti-inflammatory agents, anthelmintics, antiarrhythmic agents, antibiotics, anticoagulants, antidepressants, antidiabetic agents, antipileptics, antihistamines, antihypertensive agents, antimuscarinic agents, antimycobacterial agents, antineoplastic agents, immunosuppressants, antithyroid agents, antiviral agents, anxiolytic sedatives, astringents, beta-adrenoceptor blocking agents, blood products and substitutes, cardiac inotropic agents, corticosteroids, cough suppressants, diagnostic agents, diuretics, dopaminergics, haemostatics, immunological agents, lipid regulating agents, muscle relaxants, parasympathomimetics, parathyroid calcitonin and biphosphonates, prostaglandins, radiopharmaceuticals, sex hormones, steroids, anti-allergic agents, stimulants and anorexics, synpathomimetics, thyroid agents, PDE IV inhibitors, NK3 inhibitors, CSBP/RK/p38 inhibitors, antipsychotics, vasodilators, xanthenes, and combinations thereof. In other words, any type of chemistry, fluid, flowable solid, or the like can be incorporated with the source of positive pressure 125 in some form of communication and introduced into the interior of the core A, A1, A2, etc. as may be required to suit the circumstance and/or conditions desired by the manufacturer of convolutely wound materials that are disposed about a core A, A1, A2, etc.

It was also found that the pressurization of the core A, A1, A2, etc. can result in the benefit of reducing the amount of material required for the formation of the core A, A1, A2, etc. In other words, the basis weight of the core material can be reduced, often times dramatically, due to the fact that the modulus of the core itself can be increased by the pressurization of the core A, A1, A2, etc. during the winding process. Naturally, one of skill in the art will clearly see the benefit of the reduction of material required to form the core A, A1, A2, etc. in terms of manufactured cost. As the cost of materials required to form the core A, A1, A2, etc. increase, if the manufacturing processes that form the convolutely wound material product about the core A, A1, A2, etc. can utilize a core A, A1, A2, etc. having less basis weight, yet provide the necessary modulus that defeats the effects upon the core A, A1, A2, etc. discussed supra, the costs associated with the manufacture of such convolutely wound products would naturally decrease. In some cases, the reduction in manufacturing costs can be quite dramatic. It was found that the basis weight of material required to form a convolutely wound roll of Bounty® paper towels could be reduced at least in half. For example, a core A, A1, A2, etc. having a length of 100 inches can be formed from a material having a basis weight of less than about 100 pounds/1000 square feet, or less than about 70 pounds/1000 square feet, or less than about 50 pounds/1000 square feet, or less than about 30 pounds/1000 square feet, or less than about 25 pounds/1000 square feet, or less than about 20 pounds/1000 square feet, or less than about 10 pounds/1000 square feet, or less than about 5 pounds/1000 square feet, or less than about 2 pounds/1000 square feet, or less than about 1 pound/1000 square feet by using the surface rewinder 13 to wind web material N about a core A, A1, A2, etc. that is subjected to an internally supplied pressure during the winding process. It was also found that the internal pressurization of the core A, A1, A2, etc. material could facilitate the construction of the core A, A1, A2, etc. from materials other than conventional paperboard materials such as CRB (e.g., paperboard). By way of non-limiting example, a suitable core A, A1, A2, etc. for winding a convolutely wound material thereabout could be constructed of the material wound about the core A, A1, A2, etc. In other words, a material having a very low modulus, such as paper toweling or bath disuse could itself be used for the formation of the core A, A1, A2, etc. Since the internal pressurization of the core A, A1, A2, etc. can increase the natural modulus of the unpressurized material; such constructions from otherwise unsuitable materials would be possible. Therefore, a process that produces convolutely wound materials wound about a core A, A1, A2, etc. (e.g., paper toweling and bath tissue) can completely jettison the need for expensive materials, such as CRB, typically associated with such convolutely wound products.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A rewinding machine for convolutley winding a web material onto a core to form rolls of convolutley wound web material, said rewinding machine comprising:

a first winding drum rotatable at a first peripheral velocity;

a second winding drum located in opposition to said first winding drum and rotatable at a second peripheral velocity, said core traversing a path extending through a space defined between said first and second winding drums;

said first and second winding drums causing said core to rotate in order to convolutley wind said web material thereabout to form said rolls of convolutley wound web material;

a core support for gripping opposing ends of said core in said space and during winding of said web material about said core, said core support moving said core along said path between said first and second winding drums in which said web material is wound about said core;

said core support further comprising a first rotatable pin having a corresponding first end and a corresponding second end capable of insertion into a first end of said core and a second rotatable pin having a corresponding first end and a corresponding second end capable of insertion into a second end of said core disposed distal to said first end of said core, said first and second rotatable pins both further comprising retaining means disposed upon said corresponding second end and being capable of providing fluidly sealing engagement with a respective interior portion of said core, said first rotatable pin further comprising a channel disposed therein, said channel providing fluid communication between a source of positive pressure disposed external to said first rotatable pin and said second end of said first rotatable pin, said source of positive pressure providing a positive pressure to said interior portion of said core through said channel from said first end of said first rotatable pin to said second end of said first rotatable pin when said second ends of both said first and second rotatable pins are in fluid sealing engagement with said interior portion of said core.

2. The rewinding machine of claim 1 further comprising a supply for supplying the web material at a predefined supply speed, said first peripheral velocity of said first winding drum substantially corresponding to said predefined supply speed.

3. The rewinding machine of claim 1 further comprising a roll for influencing said core and said web material convolutely wound thereabout to bear against and remain in contact with said first and second winding drums.

4. The rewinding machine of claim 1 wherein each of said first and second rotatable pins is cooperatively associated with a respective sliding block, each of said sliding blocks facilitating slidable movement of said respective first and second rotatable pins therethrough.

5. The rewinding machine of claim 1 wherein said first winding drum is controllable so said first peripheral velocity substantially corresponds to, greater than, or less than a supply speed of said web material.

6. The rewinding machine of claim 1 wherein said space defined between said first and second winding drums substantially corresponds to a transverse size of said core.

7. The rewinding machine of claim 1 wherein said first and second rotatable pins are opposing pins that can each be operatively associated with opposing ends of said core.

8. The rewinding machine according to claim 1, wherein said path starts from a first position wherein said core support contactingly engages said core and terminates in a release position wherein said core support disengages from each of said rolls of convolutley wound web material.

9. The rewinding machine according to claim 1 wherein said core is a tubular core.

10. The rewinding machine according to claim 1 wherein said second end of each of said pins is frustoconical.

11. The rewinding machine according to claim 1 wherein said first and second rotatable pins each further comprise retaining means, said retaining means providing contacting and retaining engagement with said interior portion of said core.

12. The rewinding machine according to claim 1 wherein said first and second rotatable pins are independently rotatable.

13. The rewinding machine according to claim 1 wherein said path is linear.

14. A rewinding machine for winding a web material onto a core to form rolls, said rewinding machine comprising:

a web supply path;

along said web supply path, a first winding drum rotatable at a first peripheral velocity substantially corresponding to a web supply speed, at which said web is supplied along said web supply path, said web being fed in contact with and around said first winding drum;

a second winding drum located in opposition to said first winding drum and rotatable at a second peripheral velocity, said core traversing a path extending through a space defined between said first and second winding drums, said space having opposite inlet side and outlet side, said web supply path extending through said space from said inlet side to said outlet side;

said first and second winding drums causing said core to rotate in order to convolutley wind said web material thereabout to form said rolls of convolutley wound web material while said core is disposed within said space;

a core support for gripping opposing ends of said core in said space and during winding of said web material about said core, said core support moving said core along said path between said first and second winding drums in which said web material is wound about said core;

said core support further comprising a first rotatable pin having a corresponding first end and a corresponding second end capable of insertion into a first end of said core and a second rotatable pin having a corresponding first end and a corresponding second end capable of insertion into a second end of said core disposed distal to said first end of said core, said first and second rotatable pins both further comprising retaining means disposed upon said corresponding second end and being capable of providing fluidly sealing engagement with a respective interior portion of said core, said first rotatable pin further comprising a channel disposed therein, said channel providing fluid communication between a source of positive pressure disposed external to said first rotatable pin and said second end of said first rotatable pin, said source of positive pressure providing a positive pressure to said interior portion of said core through said channel from said first end of said first rotatable pin to said second end of said first rotatable pin when said second ends of both said first and second rotatable pins are in fluid sealing engagement with said interior portion of said core.

15. The rewinding machine of claim 14 further comprising a roll for influencing said core and said web material convolutely wound thereabout to bear against and remain in contact with said first and second winding drums.

16. The rewinding machine according to claim 14 wherein said first and second rotatable pins each further comprise retaining means, said retaining means providing contacting engagement with said interior portion of said core.

* * * * *